US006126204A

United States Patent [19]

Arkinstall

[11] Patent Number: 6,126,204

[45] Date of Patent: Oct. 3, 2000

[54] METHOD AND APPARATUS FOR IMPLEMENTING A LIVING WILL

[76] Inventor: William W. Arkinstall, #5, 757 KLO Road, Kelowna, British Columbia, Canada, V1Y 9L8

[21] Appl. No.: 08/970,219

[22] Filed: Nov. 14, 1997

Related U.S. Application Data

[60] Provisional application No. 60/031,114, Nov. 14, 1996.

[51] Int. Cl.[7] ..... B42D 15/00

[52] U.S. Cl. ..... 283/67; 40/663; 40/665; 283/45; 283/75; 283/900

[58] Field of Search ..... 40/663, 665; 283/45, 283/46, 900, 75, 67

[56] References Cited

U.S. PATENT DOCUMENTS

| | | | |
|---|---|---|---|
| 3,921,318 | 11/1975 | Calavetta | 283/75 |
| 4,154,011 | 5/1979 | Rakestraw et al. | 283/75 |
| 4,165,890 | 8/1979 | Leff | 283/900 |
| 4,226,036 | 10/1980 | Krug | 283/75 |
| 5,026,084 | 6/1991 | Pasfield | 283/75 |
| 5,241,466 | 8/1993 | Perry et al. | 364/401 |
| 5,499,293 | 3/1996 | Behram et al. | 380/4 |

*Primary Examiner*—Daniel W. Howell
*Assistant Examiner*—Monica S. Carter
*Attorney, Agent, or Firm*—Antony C. Edwards

[57] ABSTRACT

The apparatus for implementing a living will according to the applicant's method, includes a first indicator for wearing by a testator so as to adorn the testator in a readily visible fashion, and wherein the first indicator clearly indicates and communicates by a notice the existence of a living will belonging to the testator and directs a medical attendant to a second indicator carried by the testator in a portable fixed form, for example, fixed in written form on a concealable portable member such as a planar member, for example, a flexible card or the like, for indicating on a surface thereon at least the instructive terms of the living will, wherein the second indicator in the preferred embodiment may indicate the presence and location of an original living will executed by the testator in the event that the second indicator is not the original living will executed by the testator. The method of the present invention includes the steps of: (1) providing the first indicator for wearing by a testator, and (2) providing the second indicator for carrying by the testator. The method of the present invention may advantageously include the step of providing to the testator an original living will for execution by the testator.

8 Claims, 2 Drawing Sheets

METHOD AND APPARATUS FOR IMPLEMENTING A LIVING WILL

CROSS REFERENCE TO RELATED APPLICATION

This application claims priority from U.S. Provisional Patent Application No. 60/031,114 filed Nov. 14, 1996 titled Method And Apparatus For Implementing A Living Will.

FIELD OF THE INVENTION

This invention relates to the field of recording living wills, and in particular, to a method and apparatus for providing notice of the existence of a living will to a third party, and for indicating location and terms of the living will.

BACKGROUND OF THE INVENTION

A living will is a declaration made by a testator during a time of legal capacity that, if there comes a time when the testator can no longer take part in decisions affecting the testator's own future, a set of instructions are to be followed. A living will usually specifies that if a situation should arise in which there is no reasonable expectation of the testator's recovery from extreme physical or mental disability, the will directs that the testator be allowed to die and not be kept alive by medication, artificial means or "heroic measures". In particular, the testator's instructions may include some or all of the following prohibitions, or other specific directions, in the hope that those to whom the living will is addressed will regard themselves as morally bound by the provisions of the will and absolving all who follow the instructions of any legal liability:

(a) no electrical or mechanical resuscitation of the testator's heart when it has stopped beating, (b) no nourishment or liquids, (c) no mechanical respiration when the testator is no longer able to self-sustain breathing, and (d) no surgery.

The living will may equally outline what resuscitative actions, procedures and medical treatments, the testator declares should be carried out.

The living will may further designate a proxy for the purpose of making medical decisions on behalf of the testator in the event of the incapacity of the testator. A living will is typically a document running one or two pages in length.

In short, the living will is a document which declares those wishes of the testator to be carried out in medical or other circumstances in which the testator may not be in a position to let his/her wishes known.

The problem in implementing the living will, which has not been recognized nor addressed in the prior art, is that a paramedic at the scene of a life threatening accident involving the testator, or the attending physician in a hospital emergency room to which the testator is transported, will have no way of knowing of the existence or the terms of the testator's living will, assuming the testator in such situations will not be able to coherently communicate. Furthermore, in most cases, time being of the essence, the medical team will have initiated therapeutic action before the testator's family can be contacted.

Applicant is aware of U.S. Pat. No. 5,499,293 which issued on Mar. 12, 1996 to Behram et al for a Privacy Protected Information Medium Using a Data Compression Method. Behram discloses a portable memory storage device in the manner of a "smart card" that can carry a variety of data, including record of a living will. Behram fails to disclose how the presence of such data would be brought to the attention of a medic or physician in instances when the living will would actually be relevant, other than by the specific use of the Behram smart card, the recognition by the medic or physician of the Behram smart card as possibly containing relevant medical information (assuming that the existence of the card is even detected), and the existence and skilled use of the necessary de-coding hardware and software.

SUMMARY OF THE INVENTION

Applicant proposes a much simpler solution for implementing a living will. Applicant recognizes that the probability of successfully implementing a living will likely increase if the trappings of technology, such as proposed by Behram, are removed where ever possible. In the applicant's view, removing technological barriers improves the likelihood of use by frustrated potential testators and thereby avails living wills to a greater portion of those in society who wish to be left alone in certain circumstances to die with dignity.

In summary, then, the apparatus for implementing a living will according to the applicant's method, comprises a first indicator for wearing by a testator so as to adorn the testator in a readily visible fashion, and wherein the first indicator clearly indicates and communicates by a notice the existence of a living will belonging to the testator and directs a medical attendant to a second indicator carried by the testator in a portable fixed form, for example, fixed in written form on a concealable portable member such as a planar member, for example, a flexible card or the like, for indicating on a surface thereon at least the instructive terms of the living will, wherein the second indicator in the preferred embodiment may indicate the presence and location of an original living will executed by the testator in the event that the second indicator is not the original living will executed by the testator. The method of the present invention comprises the steps of: (1) providing the first indicator for wearing by a testator, and (2) providing the second indicator for carrying by the testator. The method of the present invention may advantageously include the step of providing to the testator an original living will for execution by the testator.

DETAILED DESCRIPTION OF THE PREFERRED EMBODIMENT

Figure 1:
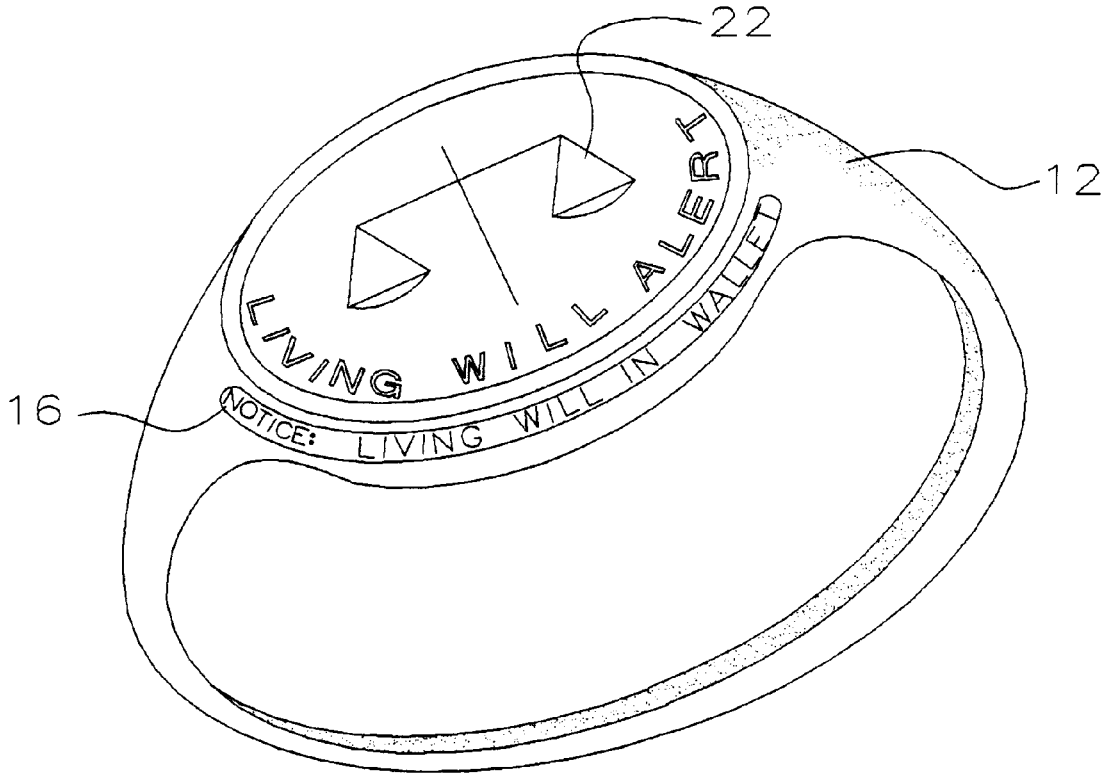
FIG. 1 is, in perspective view, an example of the form of the first indicator.
Figure 2:
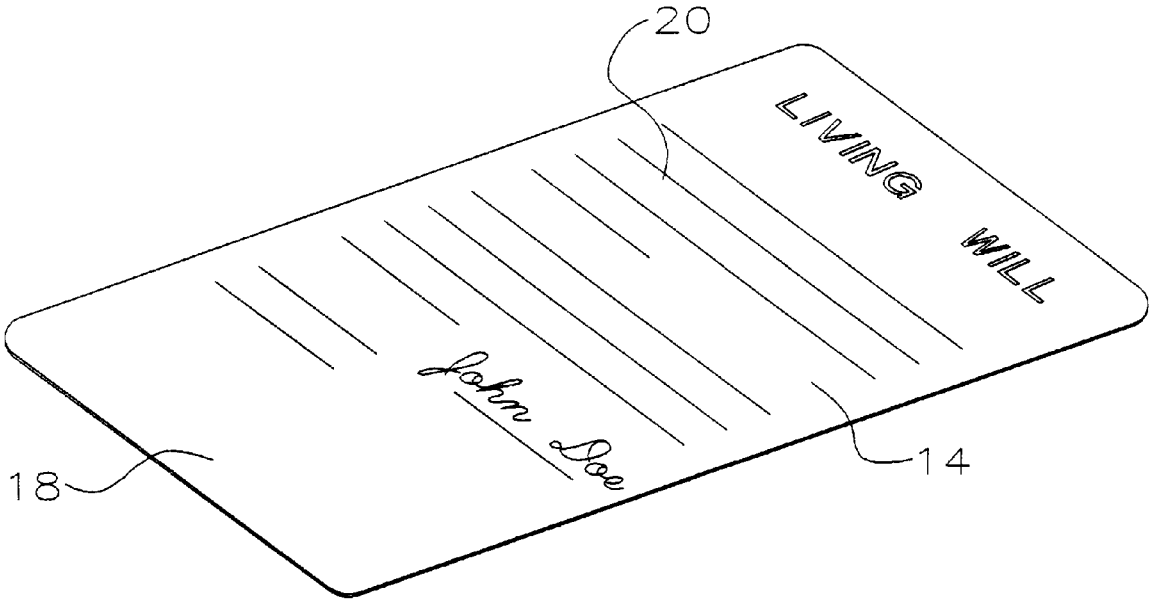
FIG. 2 is, in perspective view, an example of the form of the second indicator.

As illustrated in the accompanying FIGS. 1 and 2, but not so as to be limiting, applicant's method and apparatus of implementing a living will comprises a piece of jewellery 12 to be worn by a testator, the piece of jewellery indicating that a living will is held on a card 14, for example, carried in the wallet or purse of the testator. Such indication on jewellery 12 is given by a notice 16, which may be a textual notice or universally recognized symbol or the like or a combination of the two. The card 14 provides a second indicator indicating the testator wishes. The card 14 may be carried within the wallet or purse of the testator and summarizes the living will on its surface 18, that is, the key prohibitions or directions wished for by the testator, and gives notice of the location of the full original living will, such as the address of the testator's lawyer. In an alternative embodiment, the second indicator, that is, the card 14 may, as depicted in FIG. 2, be a reproduction 20 of the original executed living will, reduced in size and fixed as by photo-reproduction or the like onto a card 14, which may be a credit card sized planar flexible member. Jewellery 12 may be in the form of known Medic Alert (tm) bracelets, necklaces or the like, or may be more fanciful artistic jewellery in the form of Living Will Alert jewellery 12, such as the ring depicted in FIG. 1, which, just as the functional Medic Alert bracelets have become known to indicate the presence of a potentially serious medical condition, may become known to indicate the presence of a living will.

Jewellery 12 may include a symbolic icon 22 either as part of the first indicator or separately therefrom. Symbolic icon 22 may be prominently displayed or presented when jewellery 12 is worn by the testator, representing a commonly acknowledged and accepted symbol correlating the first indicator with the existence of card 14, that is, the second indicator, or the original executed living will.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. An apparatus for implementing a living will comprising:

a first indicator for wearing by a testator so as to adorn said testator with readily visible indication of the existence and location of a second indicator, said second indicator for carrying by said testator, in a fixed form on a concealable portable member, terms and conditions of said living will.

2. The apparatus of claim 1 wherein said first indicator includes a notice of the existence of a living will belonging to said testator, said notice directing a medical attendant of said second indicator.

3. The apparatus of claim 2 wherein said first indicator includes an icon representing said notice in symbolic form.

4. The apparatus of claim 1 wherein said second indicator is an abbreviation of complete terms and conditions of said living will, and said second indicator provides the location of said complete terms and conditions of said living will.

5. The apparatus of claim 4 wherein said concealable portable member is a flexible planar member for carrying in a wallet or purse.

6. The apparatus of claim 1 wherein said second indicator is a complete set of said terms and conditions of said living will reproduced in a size reduced form on said concealable portable member.

7. The apparatus of claim 6 wherein said concealable portable member is a flexible planar member for carrying in a wallet or purse.

8. A method for giving notice of terms and conditions of a living will, comprising the steps of:

(a) providing a first indicator for readily visible wearing by a testator, wherein said first indicator indicates the existence and location of a second indicator, (b) providing said second indicator for carrying by said testator, wherein said second indicator is in a fixed form on a concealable portable member and indicates terms and conditions of said living will.

* * * * *